US007108538B2

(12) United States Patent
Ratzlaff et al.

(10) Patent No.: US 7,108,538 B2
(45) Date of Patent: Sep. 19, 2006

(54) LOCKING ELECTRICAL OUTLET

(75) Inventors: Jason Daniel Ratzlaff, Templeton, CA (US); Charles Norman Elliott, Templeton, CA (US)

(73) Assignee: Templeton Ranch Development, Templeton, CA (US)

( * ) Notice: Subject to any disclaimer, the term of this patent is extended or adjusted under 35 U.S.C. 154(b) by 0 days.

(21) Appl. No.: 10/873,063

(22) Filed: Jun. 21, 2004

(65) Prior Publication Data

US 2005/0282423 A1 Dec. 22, 2005

(51) Int. Cl.
*H01R 13/625* (2006.01)

(52) U.S. Cl. ..... 439/346

(58) Field of Classification Search ..... 439/346, 439/371, 369, 651, 652, 348
See application file for complete search history.

(56) References Cited

U.S. PATENT DOCUMENTS

| | | | | |
|---|---|---|---|---|
| 2,198,504 | A | 4/1940 | Pool | |
| 3,710,304 | A | 1/1973 | Warner et al. | |
| 4,026,624 | A | 5/1977 | Boag | |
| 4,136,919 | A | 1/1979 | Howard et al. | |
| 4,141,616 | A | 2/1979 | Gottlieb | |
| 4,466,680 | A | 8/1984 | Sakai et al. | |
| 4,904,202 | A | 2/1990 | Uchida | |
| 5,271,590 | A | 12/1993 | Rosen | |
| 5,352,132 | A | 10/1994 | O'Keefe et al. | |
| 5,413,498 | A * | 5/1995 | Ursich | 439/346 |
| 5,931,702 | A * | 8/1999 | Fladung | 439/652 |
| 6,234,823 | B1 * | 5/2001 | Fuess | 439/346 |
| 6,443,753 | B1 | 9/2002 | Bludis et al. | |
| 6,457,987 | B1 | 10/2002 | Yeh | |
| 6,558,183 | B1 | 5/2003 | Ji et al. | |

FOREIGN PATENT DOCUMENTS

| | | |
|---|---|---|
| JP | 1-162566 | 6/1989 |
| JP | 11-260479 A2 | 9/1999 |
| JP | P2001-307789 | 11/2001 |

* cited by examiner

*Primary Examiner*—Phoung Dinh
(74) *Attorney, Agent, or Firm*—Nixon Peabody LLP

(57) ABSTRACT

A female locking electrical outlet is provided including an outlet body having a pair of slots for apertured prongs of a standard male electrical plug, a central cavity positioned within the body, and a channel extending partially through the body. A plunger is mounted in the channel that has a recess in a lower end, an upper end, and a first section and a second section between the lower and upper ends. The first section has a smaller cross-sectional area than a second section. A spring is partially in the recess. A pair of locking balls is mounted within the central cavity and positional within apertures in the prongs when the outlet is in a locked position. At least one unlocking mechanism is provided for compressing the spring to transition the locking balls within the central cavity from the locked position to an unlocked position. Pushing down on the unlocking mechanism compresses the spring and moves the plunger so that the first section of the plunger is aligned with the central cavity and allows each of the locking balls to move out of the apertures and along the central cavity.

The locking electrical outlet includes wall receptacles and a plug for extension cords. The locking outlets have one or more pairs of slots to connect to one or more male plugs.

6 Claims, 6 Drawing Sheets

LOCKING ELECTRICAL OUTLET

FIELD OF INVENTION

The invention is directed to an electrical plug, receptacle or other outlet that houses a wiring system for electrical current to run standard male plug-in electrical devices. More particularly, the invention is directed to locking outlets including female plugs and female locking wall receptacles to prevent disconnection of standard male plugs.

BACKGROUND OF THE INVENTION

Female locking plugs for extension cords are well known in the art; see, for example, U.S. Pat. Nos. 3,710,304; 4,133,919; and 5,352,132. In these prior art references, a female locking plug incorporates a pair of release buttons or unlocking pins that fit into the apertures of a standard male plug. However, it would be difficult to manufacture the standard type of wall receptacles using such a pair of release buttons or locking pins.

A spring locking mechanism has been designed that incorporates a spring between a pair of steel balls that move within apertures of a standard male plug to assure that a good electrical connection is made between the male plug and the female receptacle; see U.S. Pat. No. 2,198,504. However, the prior art spring locking mechanism does not use any release buttons or unlocking pins. The user simply uses sufficient force to overcome the compressive force of the spring to disconnect the male plug from the female outlet. This mechanism is not considered to be a female locking outlet of the type described above.

There is a need for a female locking electrical outlet using the same locking mechanism on extension cords as well as wall receptacles and one that can accept a plurality of male electrical plugs. There is also a need for a less complex and easier to manufacture female locking electrical outlet than those of the prior art.

SUMMARY OF THE INVENTION

One embodiment of a female locking electrical outlet of the present invention includes an outlet body having at least one pair of slots for apertured prongs of a standard electrical plug, at least one central cavity positioned within the body, and at least one channel extending partially through the body and in communication with the at least one central cavity. At least one plunger having a recess in a first end of the plunger is provided within one end of the at least one channel, a second end, and a first section between the first and second ends having a smaller cross-sectional area than a second section of the plunger between the first and second ends. At least one spring is at least partially mounted within the recess of the first end of the at least one plunger. A pair of locking balls for each of the at least one pair of slots respectively mounted within the at least one central cavity and positional within apertures in the prongs when the outlet is in a locked position. At least one unlocking mechanism is operably a part of the at least one plunger for compressing the spring to transition the locking balls within the at least one central cavity from the locked position to an unlocked position.

The locking electrical outlet of the present invention can be moved into an unlocked position by a user urging or pushing on the unlocking mechanism, which can be one end of the plunger or a single lever, button, and the like on a side arm of the plunger. In each of the embodiments of the present invention, the unlocking mechanism is conveniently assessable to the user on exterior of the outlet body. Pushing the unlocking mechanism compresses the spring and moves the plunger so that the at least one smaller cross-sectional area of the plunger is aligned with the at least one central cavity and allows each of the locking balls to move out of the apertures and along the at least one central cavity.

BRIEF DESCRIPTION OF THE DRAWINGS

Further features and advantages will become apparent from the following and more particular description of various embodiments of the present invention, as illustrated in the accompanying drawings in which.

DETAILED DESCRIPTION OF VAROUS EMBODIMENTS OF THE PRESENT INVENTION

Figure 1:
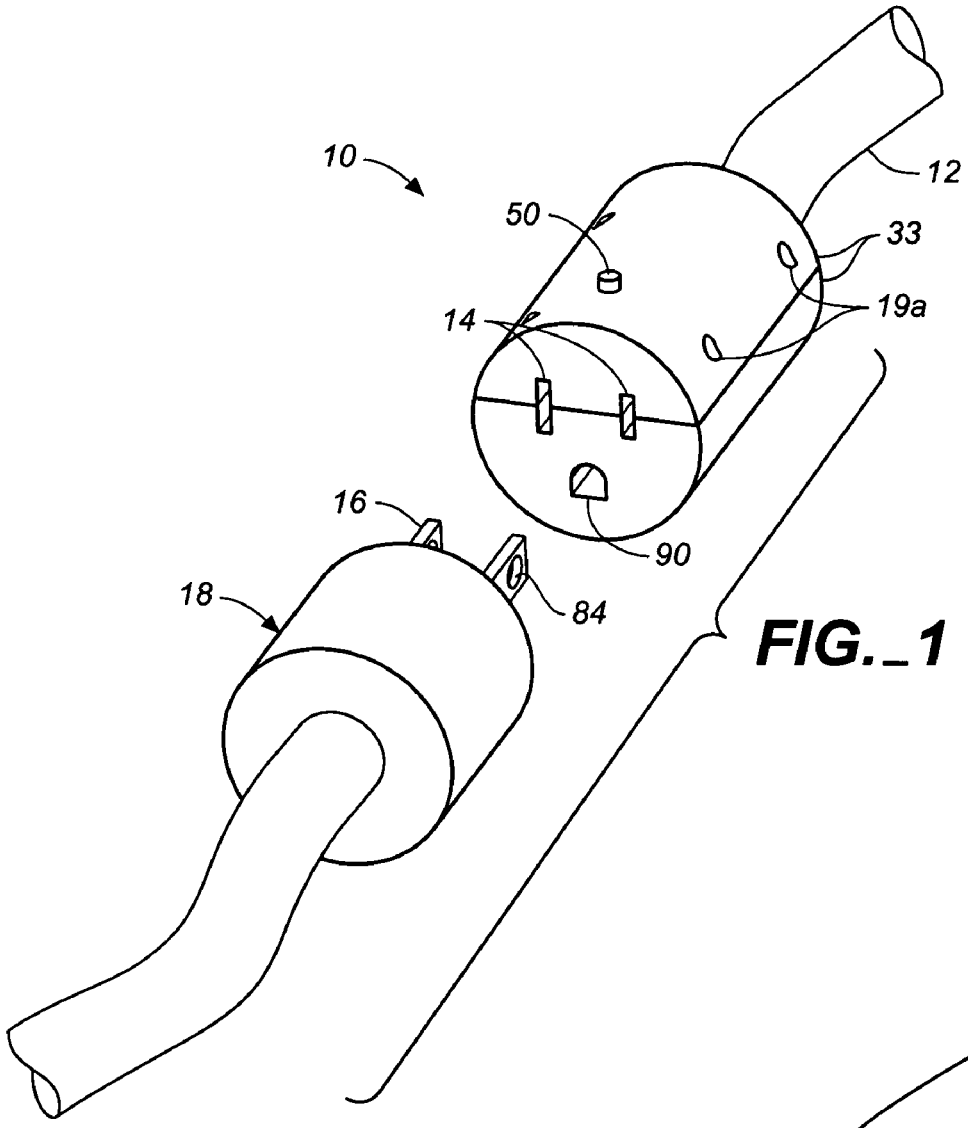
FIG. 1 is an upper right frontal perspective view of a female locking electrical outlet of one embodiment of the present invention and a standard grounded male electrical plug.
Figure 3:
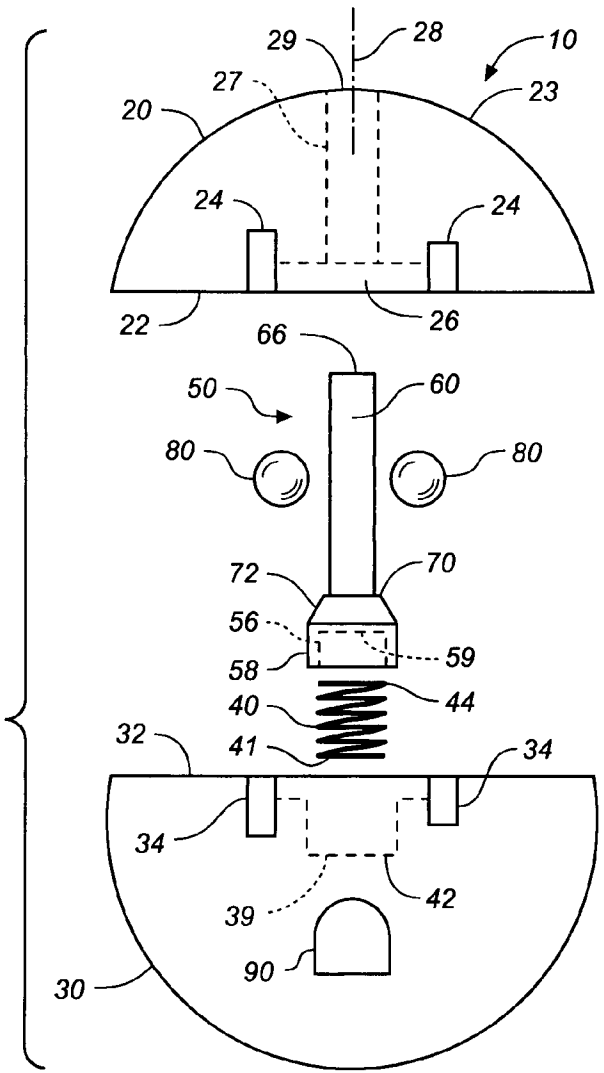
FIG. 3 is an exploded front elevation view of the female locking electrical outlet of the embodiment of FIG. 2.
Figure 2:
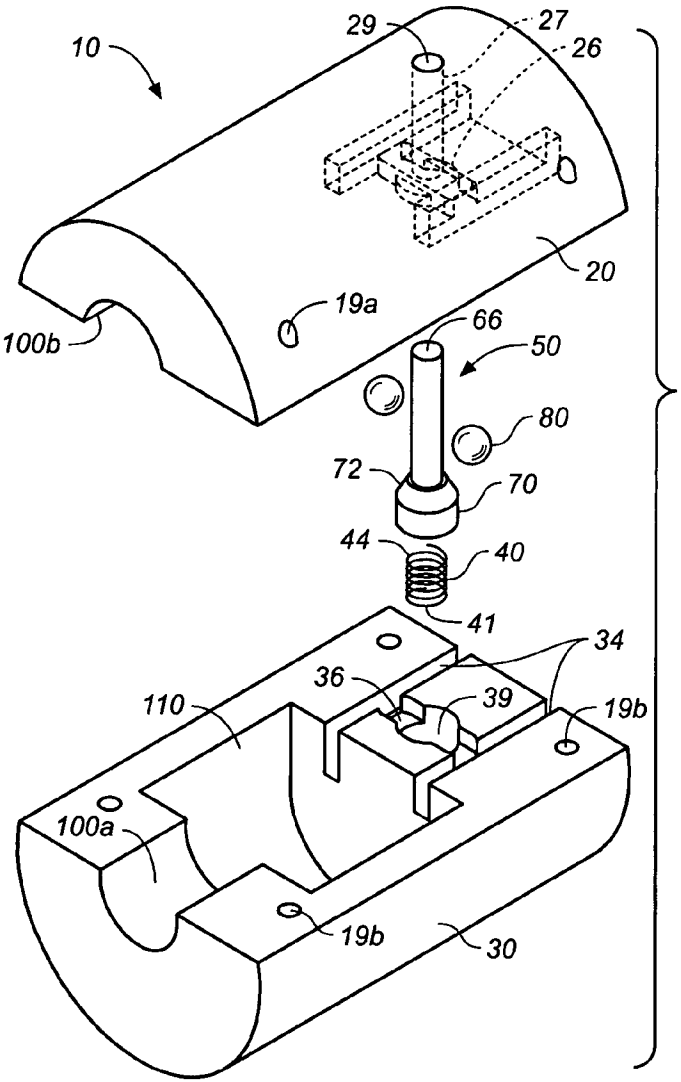
FIG. 2 is an exploded upper left rear perspective view of the female locking electrical outlet of the embodiment of FIG. 1.

FIGS. 1–6 show various views of one embodiment of the locking electrical outlet of the present invention. Specifically, FIG. 1 shows electrical outlet or female plug 10 operably mounted at the end of extension cord 12 and having a pair of slots 14 for apertured prongs 16 of a standard grounded male electrical plug 18. Outlet 10 of this embodiment is constructed by joining two major pieces as shown in FIGS. 1–3 using any suitable fastener (not shown) through holes 19*a* and 19*b*.

FIGS. 2 and 3 show upper outlet body 20 as one of the major pieces of outlet 10 having upper base 22, exterior surface 23, a pair of upper slots 24, upper central cavity 26 between the two upper slots 24, and upper channel 27. Upper channel 27 extends from upper central cavity 26 along longitudinal axis 28 transverse to the base 22 to opening 29 in exterior surface 23 of upper body 20.

The second major piece of outlet 10 is lower outlet body 30 having lower base 32 that matches upper base 22 to form outlet body 33. Upper body 20 and lower body 30 are constructed of non-conductive material, such as phenolic resins, polyvinyl chlorides and a plurality of other plastics. Upper body 20 and lower body 30 can be molded by conventional plastic molding techniques.

After joining upper body 20 with lower body 30 using standard fasteners through holes 19*a* and 19*b*, a pair of lower slots 34 is respectively aligned with upper slots 24 to form the pair of slots 14. Lower body 30 has lower central cavity 36 between the two lower slots 34 that is aligned with upper central cavity 26 to form central cavity 38 (shown in FIGS. 4A and 4B). Lower channel 39, substantially along longitudinal axis 28, preferably has a length that is at least approximately equivalent to the height of spring 40 in its uncompressed state and locked position shown in FIG. 4A. Spring 40 has lower end 41 that rests against bottom 42 of lower channel 39 and upper end 44.

Plunger 50, consisting of a non-conductive material, is mounted within upper channel 27 and lower channel 39 in outlet body 33 and has recess 56 in lower section 58. Preferably the length of recess 56 is substantially equal to the height of spring 40 in its compressed and unlocked position shown in FIG. 4B. Upper end 44 of spring 40 rests against inner wall 59 of recess 56. Lower section 58 of plunger 50 is designed to remain within lower channel 39 during both the locked and unlocked positions of outlet 10. Upper section 60 of plunger 50 has a smaller cross-sectional area than that of lower section 58 and extends along longitudinal axis 28 through the upper channel 27. The diameter of upper section 60 is designed to provide adequate clearance with the inner walls of upper channel 27. Upper end 66 of plunger 50 protrudes through opening 29 in the normal locked position of outlet 10. Shoulder 70 of plunger 50 forms the transition between the smaller cross-sectional area of upper section 60 and tapered walls 72 to the larger cross-sectional area of the lower section 58. The tapered walls 72 of plunger 50 are designed to convert the vertical motion of plunger 50 along longitudinal axis 28 to the substantially horizontal motion of locking balls 80. Shoulder 70 is not required to be an actual shoulder as shown in FIGS. 2–4B and can simply be the annulus that is the area of demarcation between upper plunger section 60 and tapered walls 72. Outlet 10 is designed so that when shoulder 70 is moved from a position about half way within central cavity 39 to the upper portion of lower channel 39, outlet 10 goes from the normally locked position to the unlocked position as described below.

Figure 4B:
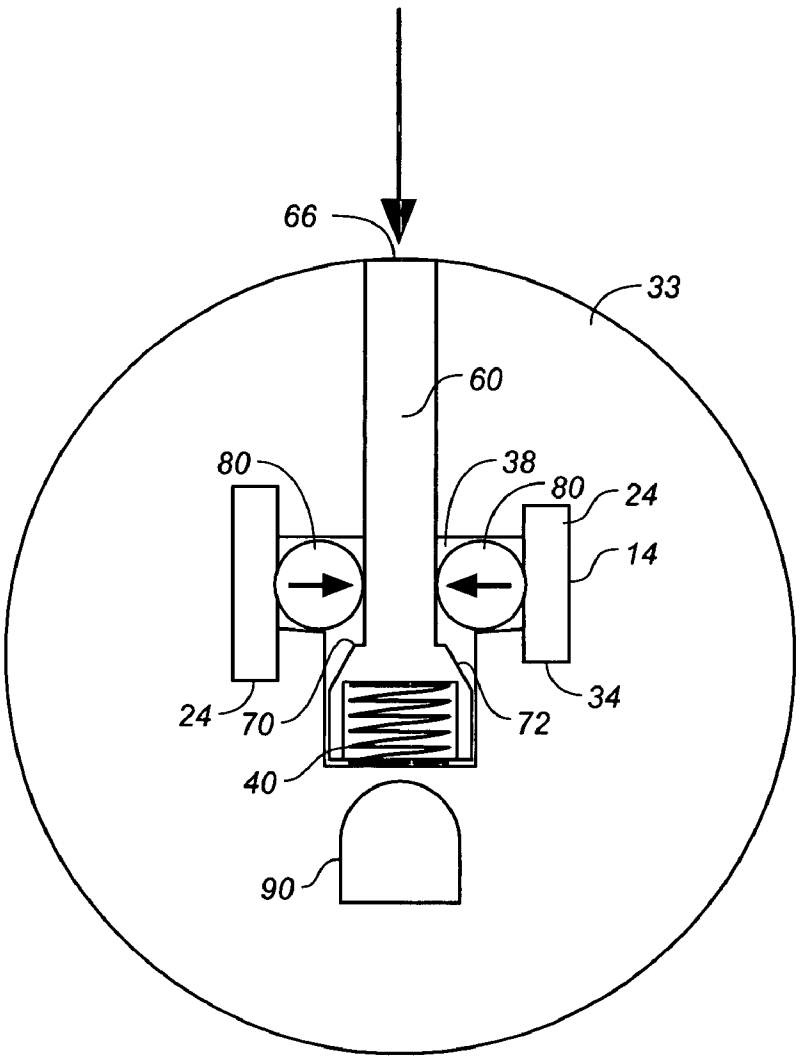
FIG. 4B is a diagrammatic front elevation view of the female locking electrical outlet of the embodiment of FIG. 2 to show the unlocked position.
Figure 4A:
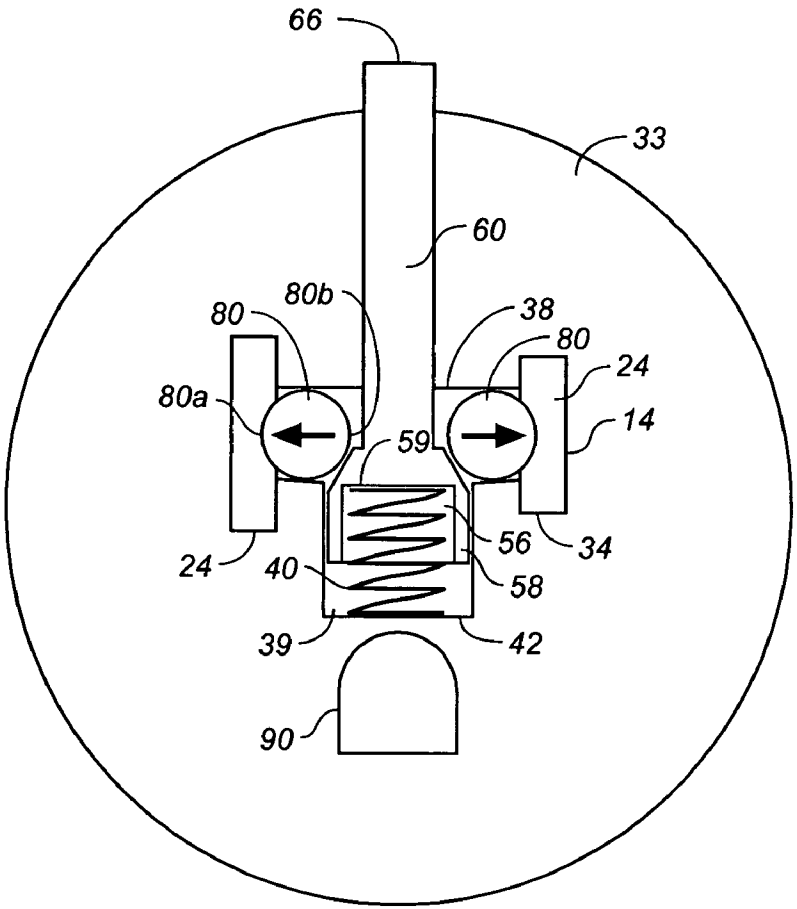
FIG. 4A is a diagrammatic front elevation view of the female locking electrical outlet of the embodiment of FIG. 2 to show the locked position.

A pair of locking balls 80 is placed within outlet body 33 and roll or otherwise move along central cavity 38 from their normal locked position diagrammatically shown in FIG. 4A to their unlocked position shown in FIG. 4B. Locking balls 80 are preferably constructed of a metal such as steel. In the normal locked position, outer portion 80*a* of each locking ball 80 is within a respective slot 14 and inner portion 80*b* is within central cavity 38 and pressed against tapered walls 72. It is critical that locking balls 80 are sized so that outer portion 80*a* substantially fills apertures 84 of prongs 16 of plug 18 when prongs 16 are electrically connected in slots 14 of outlet body 33 in the locked position. This insures that plug 18 can not be disconnected and removed from outlet 10 unless the compressive force of spring 40, preferably a coil spring, is exceeded as discussed in more detail below. Ball bearings are commercially available in a wide variety of sizes and can be used as locking balls 80.

The spring rate of coil spring 40 is designed so that amount of force needed by the user to compress spring 40 and thereby unlock balls 80 is adequate to provide the necessary force to urge walls 72 of plunger 50 against inner portion 80*b* and to prevent a disconnection of plug 18 when it is in the locked position. The calculation of the necessary spring rate for this purpose is well known by those skilled in the art who take into consideration the number of active coils, the wire diameter and the mean diameter of spring 40. This compressive force of spring 40 urges outer portion 80*a* to remain within apertures 84 until the user presses down on upper end 66 so that end 66 is substantially flush with exterior surface 23 of outlet body 33. Outlet 10 remains in the unlocked position shown in FIG. 4B as long as user continues to press on end 66. In the unlocked position, spring 40 is compressed between inner wall 59 of recess 56 and bottom 42 of channel 39. This, in turn, lowers shoulder 70 below the central cavity 38 into upper channel 39 and allows locking balls 80 to roll or otherwise move out of apertures 84.

FIGS. 4A and 4B are not to scale and are not meant to represent the actual dimensions of locking balls 80 or the size of apertures 84, upper section 60, lower section 58, and the other elements of plunger outlet 10 of the present invention. FIGS. 4A and 4B diagrammatically show the locked and unlocked positions of electrical outlet 10 of the present invention. The user presses down on upper end 66 of plunger 50 and inserts plug 18 into slots 14. When the user releases upper end 66, slopping walls 72 slide along inner portion 80*b* to cause balls 80 to roll along central cavity 38 into apertures 84 (shown in FIG. 1). Similarly, when the user pushes down on upper end 66 to compress spring 40, tapered wall 72 slides away from inner portion 80*b* to enable the user to remove plug 18. The action of prongs 16 being pulled from slots 14 allows outer portion 80*a* to move out of apertures 84. The distance from the inner wall of slot 14 and the outer wall of upper section 60 is substantially equal to the diameter of balls 80.

Figure 5:
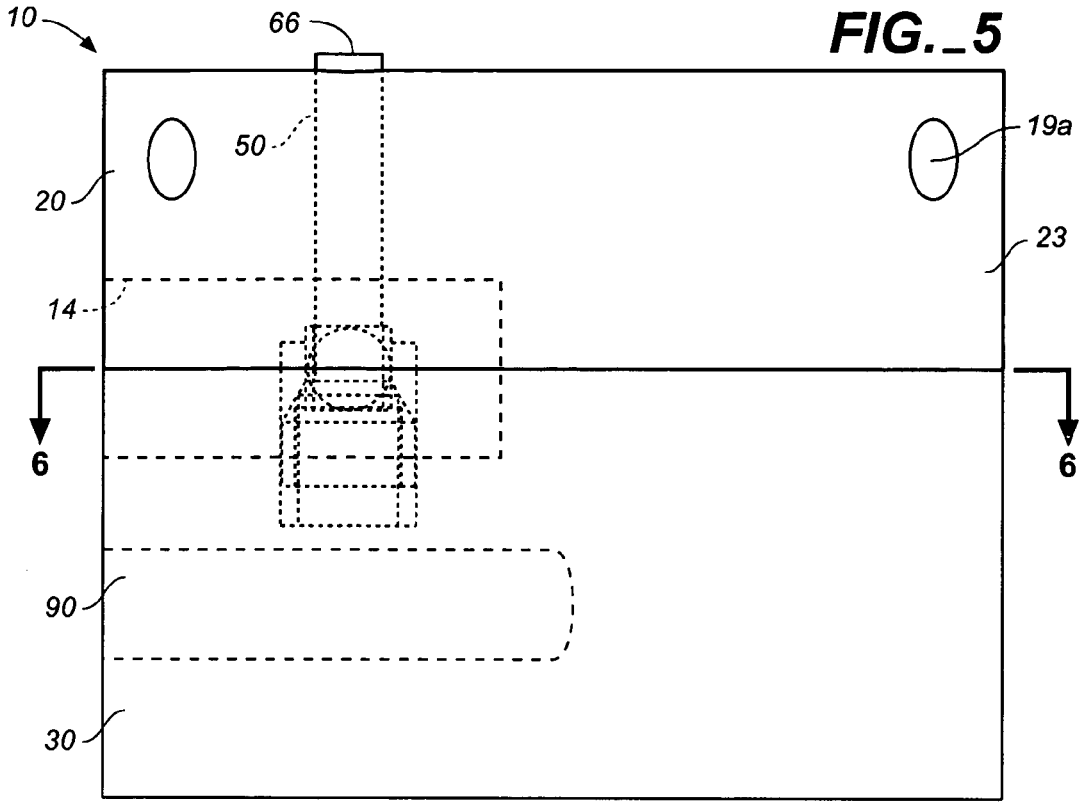
FIG. 5 is a right side view of the female locking electrical outlet of the embodiment of FIG. 2.
Figure 6:
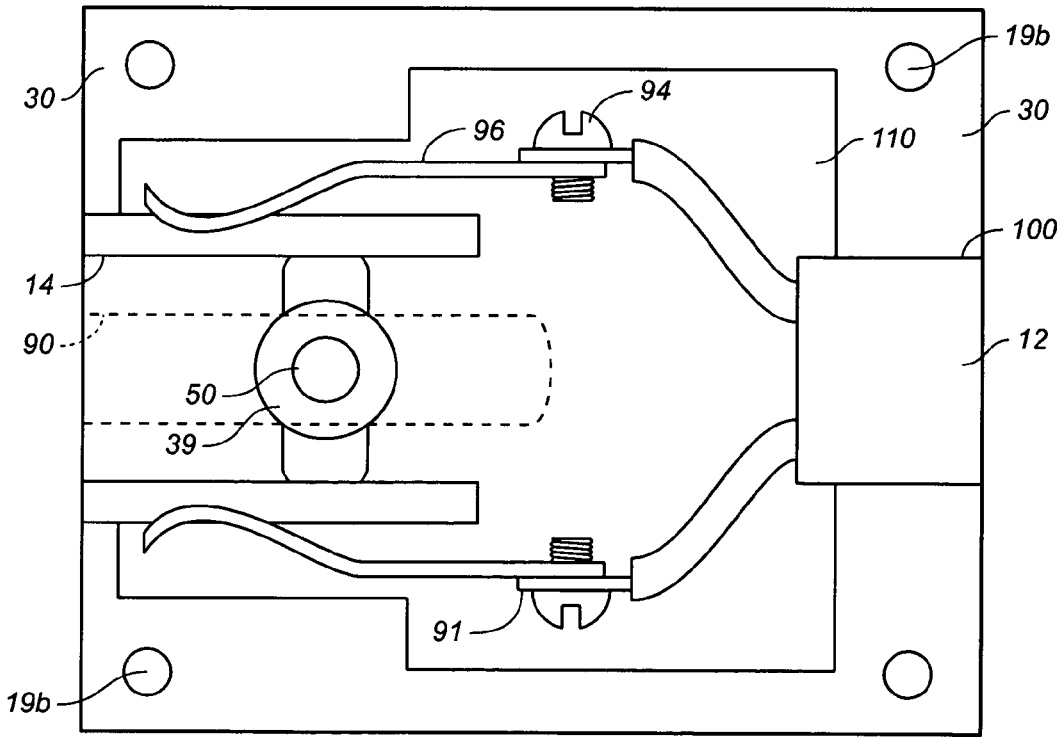
FIG. 6 is a diagrammatic top plan view of the female locking electrical outlet of the embodiment of FIG. 2 in the locked position showing a connection with the male electrical plug taken generally along line 6—6 of FIG. 5.

FIG. 6 diagrammatically is a top plan view substantially along line 6—6 of FIG. 5 to show a conventional electrical connection between electrical cord 12 and outlet 10. FIG. 6 shows ground slot 90 as a dotted section and the electrical connection between the positive and negative lines 91 and 92 of electrical cord 12 that are operably connected, e.g., by mechanism of bolts 94, to positive and negative plates 96 and 98 adjacent slots 14. Recess 100 formed by lower recess 100*a* and upper recess 100*b* shown in FIG. 2 houses the end of electrical cord 12 and recess 110 houses positive and negative lines 91 and 92 connection to positive and negative plates 96 and 98.

Figure 7:
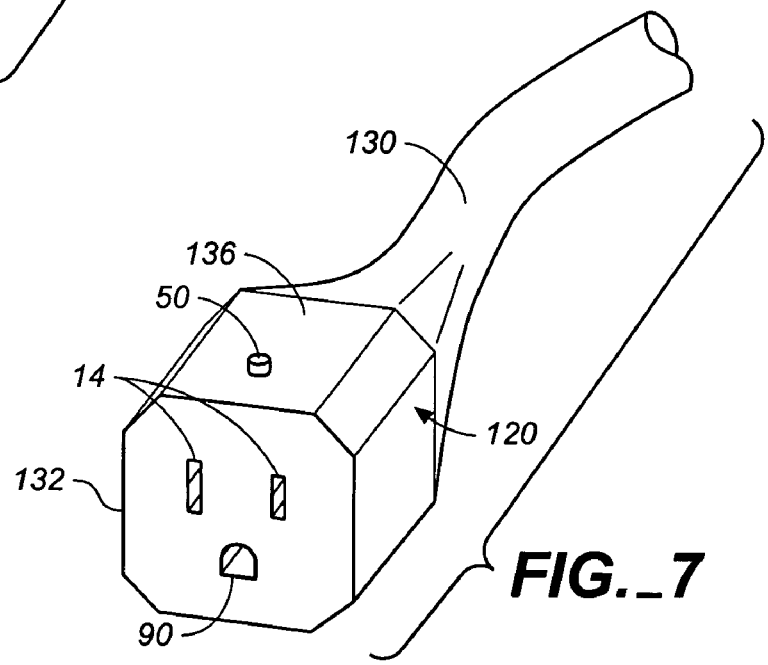
FIG. 7 is an upper right frontal perspective view of a female locking electrical outlet of another embodiment of the present invention showing a one-piece integral construction.

FIG. 7 shows female locking electrical outlet 120 at the end of extension cord 130. Outlet 120 represents another embodiment of outlet of the present invention having exactly the same internals elements including slots 14 and ground slot 90 extending from front 132 into the outlet body and plunger 50 protruding above top 136 as discussed above in connection with FIGS. 1–6. Outlet 120 is of one-piece integral construction using molding techniques well known to those skilled in the art. Outlet 120 can also be made with a removable back (not shown).

Figure 8:
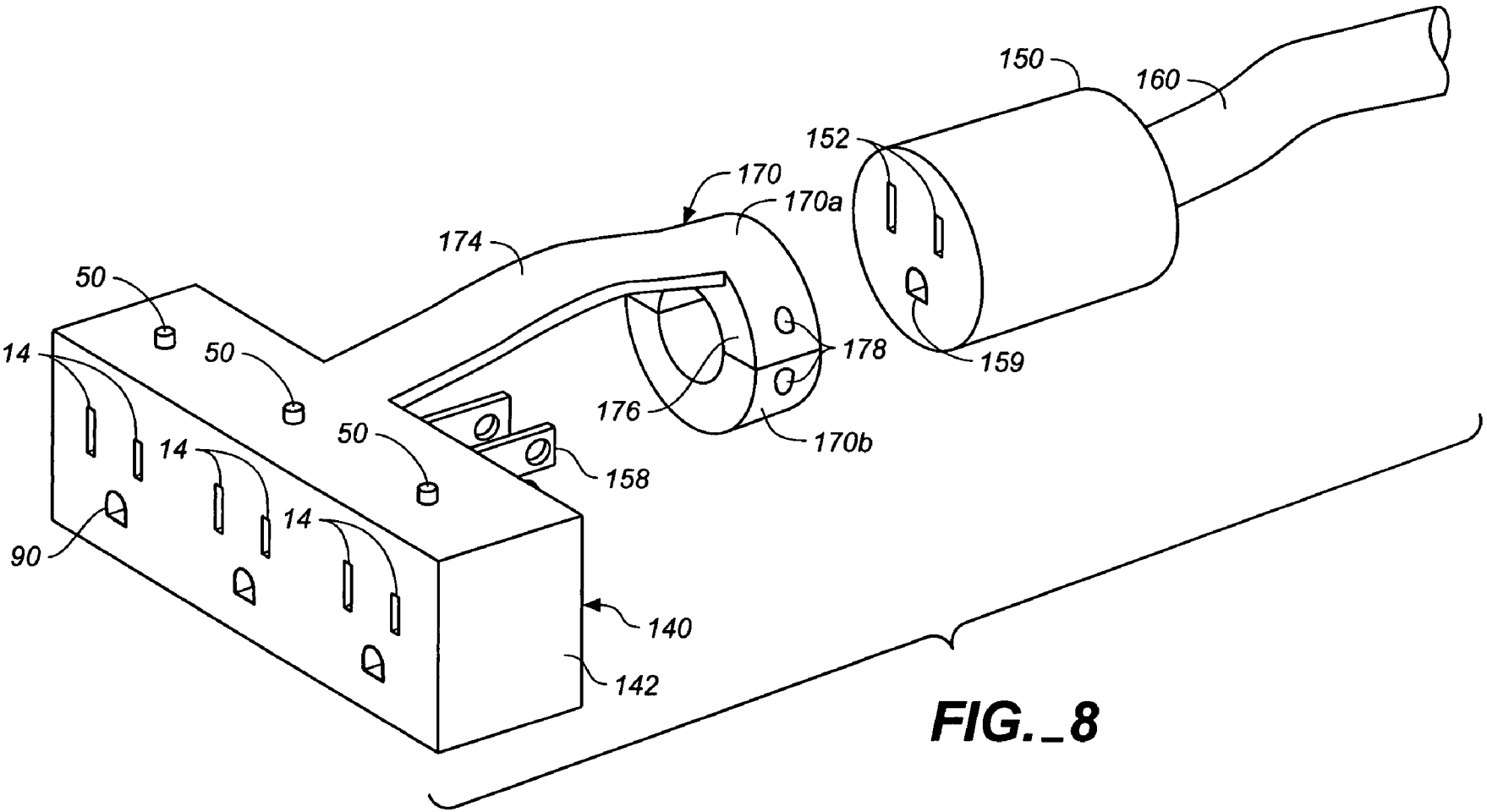
FIG. 8 is an upper right frontal perspective view of a standard grounded electrical female plug and extension cord and multiple female locking electrical outlets of still another embodiment of the present invention adapted to connect to multiple standard grounded male electrical plugs.

FIG. 8 shows multiple female grounded locking outlets 140 being adapted to fit onto standard single grounded outlet 150. Standard outlet 150 has a single pair of slots 152 for prongs 158 of female outlet 140 and ground slot 159 for the ground (not shown) of outlet 140 at the end of extension cord 160. Multiple locking outlets 140 are housed within non-conducting outlet body 142 that are coupled to outlet 150 by non-conducting connecting collar 170. Preferably, non-conducting connecting strap 174 is molded into the back of outlet body 142 and into front face 176 of upper half 170*a* of collar 170 as shown in FIG. 8. Specifically, outlet body 142 is coupled to standard outlet 150 by placing upper half 170*a* and lower half 170*b* around cord 160. Prongs 158 and the ground are respectively connected to the pair of slots 152 and ground slot 159 and then upper half 170*a* is fastened to lower portion 170*b* by any suitable fastener through holes 178. It is apparent that collar 170 can be made as a single unit with a hinge connecting upper half 170*a* to lower half 170*b* on either the right or left sides.

Multiple locking outlet 140 represents still other embodiment of outlet of the present invention having substantially the same internals elements discussed above in connection with FIGS. 1–6. Corresponding to each of the pairs of slots 14, there is ground slots 90, central cavity 26, upper channel 27, opening 29, lower channel 39, spring 40, plunger 50, and a pair of locking balls 80. In this embodiment for each of the three pairs of slots 14 shown in FIG. 8 for outlet 140, there are the following internal elements housed within outlet body 142: plungers 50, pairs of locking balls 80, and spring 40. Although the later three elements are not shown in FIG. 8, they are the same as that shown in FIGS. 2 and 3. Electrical connections (not shown) are made between prongs 158 and the three ground slots 90 and the three pairs of slots in a conventional manner to that described above in connection with FIG. 6.

After collar 170 at one end of strap connecting strap 174 of outlet body 142 is temporarily connected to standard female outlet 140, prong 158 is electrically connected to outlet 140 and collar 170 is firmly attached to cord 160. Locking outlets 140 is shown capable of receiving three separate male plugs. The use of three pairs of slots 14 is merely exemplary and more than three pairs can easily be assembled in the manner described above.

Figure 9C:
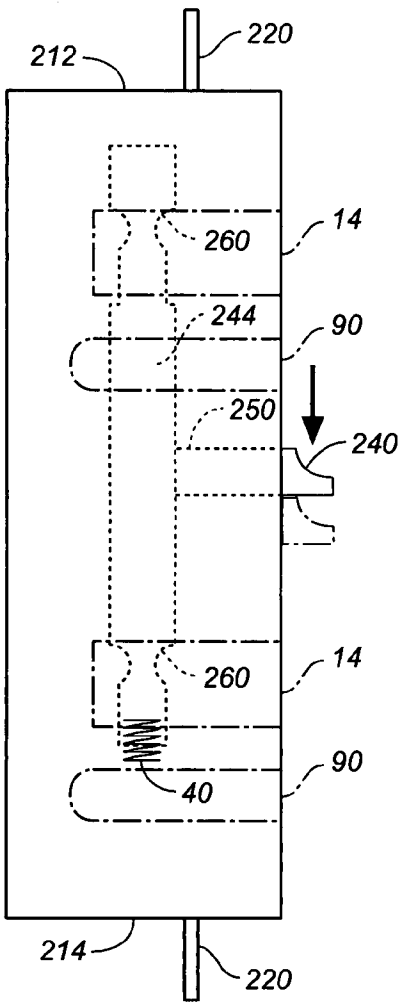
FIG. 9C is a left side view of the female locking wall receptacle of the embodiment of FIG. 9A.
Figure 9B:
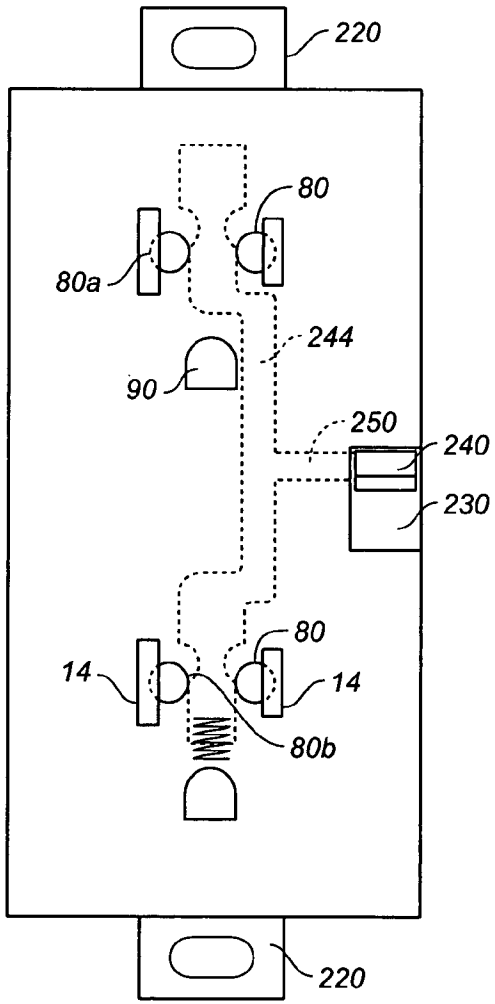
FIG. 9B is a front view of the female locking wall receptacle of the embodiment of FIG. 9A.
Figure 9A:
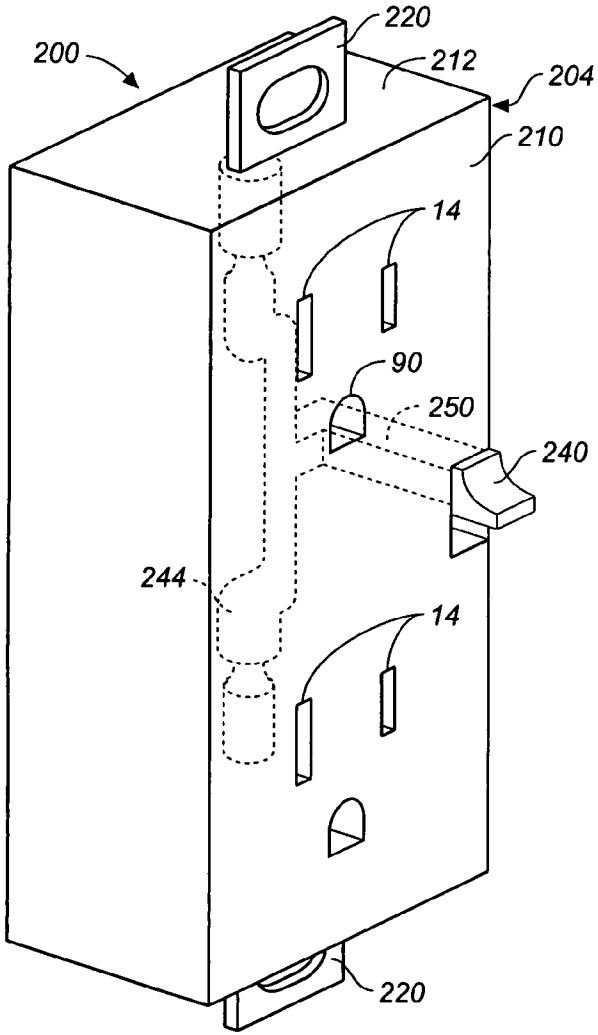
FIG. 9A is an upper left side and front perspective view of a female locking wall receptacle or electrical outlet of another embodiment of the present invention.

FIGS. 9A–9C show female locking wall electrical outlet 200 of still another embodiment of the present invention. Locking outlet 200 has outlet body 204 that can be equivalent in size and shape to standard home grounded, wall receptacles designed to accommodate standard grounded electric plugs 18 shown in FIG. 1.

Outlet body 204 has front 210 with openings for the two pairs of slots 14 and the two ground slots 90 and top 212 and bottom 214 from which protrude standard fixture mounting tabs 220. However, protruding through front 210 of outlet body 204 of this embodiment is the outer end of notch or channel 230 and release button 240 of spring-loaded plunger 244. Pushing down on button 240 serves the equivalent unlocking mechanism as pushing down on top 66 of plunger 50. Plunger 244 is positioned within a corresponding channel or other similar framework (not shown) that is molded within outlet body 204 as in the embodiment described in connection with FIGS. 1–6. This channel is generally positioned along a longitudinal axis of outlet body 204. Two pairs of locking balls 80 are within respective central cavities (not shown) in the same or similar manner as described above in connection with FIGS. 1–6. The lower end of spring 40 rests against the bottom of the lower portion of this channel and the upper end of spring 40 rests against an inner wall of a recess in plunger 244 in a similar manner as that of the embodiment shown in FIGS. 1–6. Side arm 250 within notch 230 is attached at its inner end to plunger 244 and extends transverse to the longitudinal axis and is connected at its outer end to release button 240. Preferably, plunger 244 and side arm 250 are molded as one piece to make side arm 250 an integral part of plunger 244.

FIGS. 9A–9C show female locking wall receptacle or electrical outlet 200 in the normally locked position with outer portion 80*a* of both pairs of locking balls within each of slots 14 and movable into apertures 84 of plugs 18 when plugs 16 are electrically connected to locking outlet 200. Indentations 260 in plunger 244 serve the same function as tapered wall 72 of plunger 50 described above in connection with FIGS. 1–6. When the user presses down on release button 240, spring 40 is compressed and plunger 244 is lowered to align the smaller cross-section area of indentations 260 with locking balls 80. This permits locking balls 80 to move in the same generally horizontal direction from apertures 84 to enable the user to remove plug 18 as describe above.

The spring rate of coil spring 40 in this embodiment is similarly designed so that amount of force needed by the user to compress spring 40 and thereby unlock balls 80. This force is adequate to urge the wall of plunger 244 having a large cross-sectional area above indentation 260 of plunger 244 against inner portion 80*b* and to prevent a disconnection of plug 18 when it is in the locked position. To simplify the manufacturing process, the spring rate necessary to accomplish the amount of compressive force for the most severe application is used to design a single spring of a size that will fit each of the embodiments described above.

Without departing from the spirit and scope of this invention, one of ordinary skill in the art can make various changes and modifications to the device of the present invention to adapt it to various usages and conditions. For example, while the locking electrical outlets of the present invention are normally orientated along a longitudinal axis, modifications can be made to this orientation without adversely affective the effectiveness of the locking function. Similarly, various shapes of the elements of the various embodiments may be varied from those shown without altering their operation. As such, these changes and modifications are properly, equitably, and intended to be, within the full range of equivalents of the following claims.

What is claimed is:

1. A female locking electrical outlet (10) having a pair of slots (14) for apertured prongs (16) of an electrical plug (18) comprising:

an upper body (20) having an upper base (22), an exterior surface (23), a pair of upper slots (24), an upper central cavity (26) between the two upper slots (24), and an upper channel (27) extending from an upper central cavity (26) along an axis (28) transverse to the base (22) to an opening (29) in the exterior surface (23);

a lower body (30) having a lower base (32) matching the upper base (22) to form the outlet body (33), a pair of lower slots (34) respectively aligned with the upper slots (24) to form the pair of slots (14), a lower central cavity (36) between the two lower slots (34) and aligned with the upper central cavity along the axis (28) to form a central cavity (38), and a lower channel (39);

a fastener for joining the upper body (20) to the lower body (30);

a spring (40) having a lower end resting on the bottom (42) of the lower channel (39);

a plunger (50) having a recess (56) in a lower section (58) within the lower channel (39), an inner wall 59 of the recess in contact with an upper end of said spring (40), an upper section (60) having a smaller cross-sectional area than that of the lower section (58) and extending through the upper channel (27), an upper end (66) extending through the opening (29), a shoulder (70) within the central cavity (38) during a locked position, tapered walls (72) joining the shoulder (70) to the lower section (58);

a pair of locking balls (80) mounted on the shoulder (70) within the central cavity (38), each of the pair of balls (80) respectively adjacent each of the pair of the slots (14) and positional within apertures (84) in the prongs (16) during the locked position;

wherein the electrical outlet (10) is moved into an unlocked position by a user urging the upper end (66) and causing the spring (40) to compress and lower the shoulder (70) below the central cavity (38) and allowing the locking balls (80) to move out of the apertures.

2. The electrical outlet of claim 1, wherein the lower body has a slot for a grounded prong of the electric plug.

3. The electrical outlet of claim 2, wherein the locking balls are made of stainless steel and the outlet body and the plunger are made of non-conducting materials.

4. The electrical outlet of claim 1, wherein the spring is a coiled compression type that has sufficient force to prevent unwanted unlocking of the outlet.

5. The electrical outlet of claim 1, wherein said body has multiple pairs of slots for multiple male electrical plugs and has, for each pair of slots, the central cavity, the upper channel, an opening, a lower channel, a spring, a plunger, a pair of locking balls.

6. A female locking electrical outlet comprising:

an outlet body for wall mounting having a front, a back, a top, a bottom, a right side, a left side, two pairs of slots within the body for apertured prongs of a male electrical plug, two central cavities, and a channel extending at least partially through the body generally along a longitudinal axis and in communication with each of the central cavities;

a plunger in the channel having a lower end of the at least one channel, a recess in the lower end, an upper end, and a first section and a second section between the first and second ends, the first section having a smaller cross-sectional area than a second section of the channel, each of the sections between the first and second ends;

a spring within at least a portion of the recess;

a pair of locking balls for each of the two pairs of slots respectively mounted within each of the two central cavities and positional within apertures in the prongs when said outlet is in a locked position;

an unlocking mechanism having notch that is transverse to the longitudinal axis that extends from the channel to the front, a side arm and attached to said plunger between the upper and lower ends that extends from the plunger through the notch to the front of said body, a release button attached to the side arm for compressing the at least one spring to transition the locking balls within the at least one central cavity from the locked position to an unlocked position; and wherein the electrical outlet is moved into an unlocked position by a user pushing down on the release button of the locking mechanism to compress the spring and move the plunger so that the at least a portion of the first section is aligned with the at least one central cavity and allowing each of the locking balls to move out of the apertures and along the at least one central cavity.

* * * * *